US012442570B1

(12) United States Patent
Avidan et al.

(10) Patent No.: US 12,442,570 B1
(45) Date of Patent: Oct. 14, 2025

(54) CLOSED-LOOP CLIMATE CONTROL SYSTEM WITH THERMOELECTRIC COOLER

(71) Applicant: AVIDAN'S CANADA INC., Innisfil (CA)

(72) Inventors: Guy Avidan, Tel Aviv (IL); Itai Shamir, Binyamina (IL)

(73) Assignee: AVIDAN'S CANADA INC., Innisfil (CA)

( * ) Notice: Subject to any disclaimer, the term of this patent is extended or adjusted under 35 U.S.C. 154(b) by 0 days.

(21) Appl. No.: 18/947,559

(22) Filed: Nov. 14, 2024

Related U.S. Application Data

(60) Provisional application No. 63/664,776, filed on Jun. 27, 2024.

(51) Int. Cl.
*F25B 21/02* (2006.01)
*F25B 41/20* (2021.01)

(52) U.S. Cl.
CPC ..... *F25B 21/02* (2013.01); *F25B 41/20* (2021.01)

(58) Field of Classification Search
None
See application file for complete search history.

(56) References Cited

U.S. PATENT DOCUMENTS 2,152,251 A * 3/1939 Gay ..... F24F 6/14 261/DIG. 54
3,116,612 A * 1/1964 Pennington ..... F24F 5/0035 62/93
3,907,942 A * 9/1975 Bradley, Jr. ..... F28F 27/003 261/36.1
4,361,525 A * 11/1982 Leyland ..... F24F 6/04 261/36.1
5,092,129 A * 3/1992 Bayes ..... B64G 6/00 62/259.3
6,418,728 B1 * 7/2002 Monroe ..... F24F 5/0042 62/3.2
6,938,434 B1 * 9/2005 Fair ..... F24F 5/0035 261/118
8,490,422 B2 * 7/2013 Al Watban ..... F24F 6/043 236/44 C
9,447,994 B2 * 9/2016 Barnhart ..... B60H 1/00885
10,625,566 B2 * 4/2020 Androulakis ..... B60N 2/5678
12,031,747 B1 7/2024 Mefford et al.
2007/0163280 A1 * 7/2007 Meerpohl ..... F28F 25/04 62/310
2010/0326091 A1 * 12/2010 Enayati ..... F24F 11/84 62/305

(Continued)

FOREIGN PATENT DOCUMENTS

AU 683758 B2 * 11/1997
CN 113251523 A * 8/2021 ..... F24F 5/0035

(Continued)

*Primary Examiner* — Jenna M Maroney
(74) *Attorney, Agent, or Firm* — The Roy Gross Law Firm, LLC; Roy D. Gross

(57) ABSTRACT

A closed-loop climate system including a water tank; cooling pads positioned above the water tank, a thermoelectric unit (TEU) connectable to a power supply, and configured to cool/heat water received from the water tank, a sprinkler tube positioned above the cooling pads and configured to sprinkle the water heated by the TEU onto the cooling pads.

13 Claims, 5 Drawing Sheets

(56) References Cited

U.S. PATENT DOCUMENTS

| | | | | |
|---|---|---|---|---|
| 2014/0075959 | A1* | 3/2014 | Lenkszus | F24F 6/043 62/305 |
| 2020/0048875 | A1 | 2/2020 | Subramanian | |
| 2020/0208879 | A1* | 7/2020 | Ha | F24H 15/345 |
| 2021/0310729 | A1* | 10/2021 | Alexander | F25D 15/00 |
| 2023/0028234 | A1* | 1/2023 | Varma | F24F 3/1411 |

FOREIGN PATENT DOCUMENTS

| | | | | |
|---|---|---|---|---|
| CN | 218577529 | U | 3/2023 | |
| GB | 2566602 | A * | 3/2019 | F24F 5/0042 |
| IN | 201941011314 | | 3/2019 | |
| IN | 202021003406 | | 1/2020 | |
| KR | 101324720 | B1 * | 11/2013 | |
| KR | 102388630 | B1 | 4/2022 | |
| KR | 102605110 | B1 | 11/2023 | |

* cited by examiner

CLOSED-LOOP CLIMATE CONTROL SYSTEM WITH THERMOELECTRIC COOLER

TECHNOLOGICAL FIELD

The present invention generally relates to low power climate control system using a thermoelectric cooler and cellulose honeycomb cooling pad.

BACKGROUND

Due to climate changes, home temperature regulators, such as air conditioning systems, have become a necessity required in more and more homes worldwide. However, these climate systems typically have high energy consumption, and since energy resources become increasingly expensive, their use significantly impacts household expenditure.

Moreover, today's air conditioning solutions have complex and expensive setup including an electricity line, a copper gas tube, an internal unit, and an external unit. Moreover, air conditioning systems typically utilize freon gas or other refrigerants whose use is restricted in many countries due to its harm to the environment.

Evaporative coolers have also been described. An evaporative cooler (also known as evaporative air conditioner, swamp cooler, swamp box, desert cooler and wet air cooler) is a device that cools air through the evaporation of water. Evaporative cooling differs from other air conditioning systems, which use vapor-compression or absorption refrigeration cycles. Evaporative cooling exploits the fact that water will absorb a relatively large amount of heat in order to evaporate. The temperature of dry air can be dropped significantly through the phase transition of liquid water to water vapor (evaporation). This can cool air using much less energy than refrigeration.

However, evaporative cooling alone often proves inadequate to cool building on hot/dry and/or humid days e.g. for example when outdoor temperatures exceed about 30-35° C., and/or when the relative humidity exceeds about 50%, which happens more and more often all over the world.

There therefore remains a need for an efficient yet low power cooling system.

SUMMARY OF THE INVENTION

The present invention provides a novel solution for home temperature control among with low electricity expenses.

The herein disclosed climate control system contains three main components:

1. Evaporative air conditioning component that uses evaporation to help cool the air, Hot air is drawn through water-soaked cooling pads. As the air is pushed by one or more fans such as motor axial fan, cross flow fan and/or vertical Fan through these pads, the water evaporates and the heat in the air is absorbed, which lowers the air temperature. The cooling pads are moistened by a water pump (or other hydraulic system) that delivers water to the cooling pads and the cooled air is then blown into the room. Advantageously, the cooling pads may be honeycomb pads that ensure good water retention.
2. A thermoelectric water cooler (TEC), also known as a Peltier water cooler, is a type of water-cooling system that uses the thermoelectric effect to cool or heat water. The thermoelectric effect is a phenomenon where the application of an electric current of two different conductors creates a temperature difference. In a thermoelectric water cooler, one side of a thermoelectric module is placed in contact with the water to be cooled or heated, while the other side is placed in contact with a heat sink cooled by an axial fan for absorbing the opposite energy. When an electric current is applied to the module, it will absorb heat from the water and transfer it to the heat sink, thereby cooling the water. Advantageously, while working, the thermoelectric module (TEG) can generate electricity that can power other electrical parts of the system, thereby reducing electricity usage.
3. Control unit: A user will be able to control the operation of the herein disclosed climate control system, e.g. via an application running on a remote computing device, such as but not limited to a mobile application. For example, a user may select the operation mode of the system (heating/cooling mode); fan speed, drainage of the water tank when it is not in use for an extended period, temperature selection, water addition or the like.

Advantageously, the system provides direct, localized cooling or heating to a specific room, which often is more efficient as cooling of unnecessary spaces is avoided. Moreover, the system ads moisture to the air dispersed into the room, as opposed to air conditioning systems, which generate a dry, often unpleasant room air atmosphere.

As a further advantage, the herein disclosed system is compact and lightweight, thus making the, portable thus enabling "follow me cooling".

Importantly, the system is environmentally friendly, not just because the low energy requirements provide a beneficial carbon footprint, but also because no harmful refrigerants are used. Moreover, the system is characterized by a low operational noise thus essentially eliminating noise pollution.

As a further advantage, and as opposed to evaporative coolers, the herein disclosed climate system allows precise temperature control.

According to some embodiments, there is provided a closed-loop climate system comprising:

- an evaporative air conditioning component comprising:
  - a water tank;
  - one or more cooling pads positioned above the water tank;
  - a sprinkler tube (or other water dispersion element such as a sprayer or the like) positioned along and above the cooling pads, the sprinkler tube comprising a plurality of sprinkler holes through which water from the water tank can be sprinkled on the cooling pads;
  - a pump or other hydraulic system configured to draw water from the water tank to the sprinkler tube;
  - one or more fans configured to draw-in room air end expel/distribute air cooled via the cooling pads;
  - a thermoelectric unit (TEU) connectable to a power supply, and configured to cool/heat water flowing therethrough, wherein the TEU is positioned between, and fluidly connected to the water tank and the sprinkler tube, such that water drawn from the water tank is cooled by the TEU prior to reaching the sprinkler tube; and
  - a temperature controlled by the microcontroller configured to control operation of the TEU, thereby controlling the temperature of the expelled/distributed air.

According to some embodiments, each of the one or more fans may be an axial fan, a cross-flow fan and/or a vertical fan. Each possibility is a separate embodiment.

According to some embodiments, the TEU comprises one of more thermoelectric components (TEC), wherein each TEC comprises: a heat exchanger comprising a water inlet and a water outlet; a thermoelectric module (TEM); and a heat sink.

According to some embodiments, the TEU further comprises an auxiliary fan, positioned between the TECs or heat sinks and configured to cool the heat sinks.

According to some embodiments, by changing current flow therethrough, the TEU is further configured to heat water flowing therethrough.

According to some embodiments, the system further comprises a radiator.

According to some embodiments, the hydraulic system comprises a pump. According to some embodiments, the pump is an electrical pump. According to some embodiments, the hydraulic system further comprises one or more valves configured to direct the flow of the water. According to some embodiments, the valve is a solenoid valve.

According to some embodiments, during a cooling mode of the system, the (solenoid) valve is configured to control water flow from the water tank, via the TEU to the sprinkler tube, and wherein during a heating mode of the system, the (solenoid) valve is configured to draw water from the water tank, via the TEU to the radiator.

According to some embodiments, the TEU is a thermoelectric generator (TEG) and wherein the power generated by the TEG is powering at least a portion of the energy required by the system.

According to some embodiments, the microcontroller is controllable via a mobile/tablet application.

According to some embodiments, the power supply is a DC power supply.

According to some embodiments, the system further comprises one or more sensors configured to provide feedback to the microcontroller.

According to some embodiments, the one or more sensors comprises a temperature sensor. According to some embodiments, the one or more sensors comprises a water level indicator. According to some embodiments, wherein the microcontroller is configured to maintain a set/selected temperature based on the feedback from the temperature sensor.

According to some embodiments, the one or more sensors comprises a humidity sensor. According to some embodiments, the microcontroller is configured to maintain a set/selected humidity, based on the feedback from the humidity sensor.

According to some embodiments, the excess water from the wetted/humidified cooling pads drips back into the water tank.

According to some embodiments, the cooling pads are honeycomb cooling pads.

According to some embodiments, the water tank U-shaped having an open length side, wherein the open length side is configured to face an installation wall. According to some embodiments, the one or more cooling pads comprises three cooling pads, each positioned above another side of the water tank's, three sides. According to some embodiments, the fan is positioned behind or in front of a front-facing cooling pad of the one or more cooling pads. According to some embodiments, the system is essentially flat (similarly to a standard air-conditioning unit) and includes a single rectangular water tank (parallel to an installation wall of the evaporative air conditioning component.

According to some embodiments, the system is devoid of an external unit.

According to some embodiments, the system is portable.

According to some embodiments, the sprinkler tube is closed-ended.

According to some embodiments, there is provided a climate system comprising:

an evaporative air conditioning component comprising:
- a water tank;
- one or more cooling pads positioned above the water tank;
- a sprinkler tube positioned along and above the one or more cooling pads, the sprinkler tube comprising a plurality of sprinkler holes through which water from the water tank can be sprinkled on the one or more cooling pads;
- a hydraulic system configured to draw water from the water tank to the sprinkler tube; and
- and one ore more fans configured to draw-in room air end expel/distribute air cooled via the cooling pads;

a thermoelectric unit (TEU) connectable to a power supply, and configured to cool water flowing therethrough, wherein the TEU is positioned between, and fluidly connected to the water tank and the sprinkler tube, such that water draw from the water tank is cooled by the TEU prior to reaching the sprinkler tube; and a temperature microcontroller configured to control operation of the TEU, thereby controlling the temperature of the expelled/distributed air.

According to some embodiments, the TEU comprises one of more thermoelectric components (TEC). According to some embodiments, the TEC comprises: a heat exchanger comprising a water inlet and a water outlet; a thermoelectric module (TEM); and a heat sink. According to some embodiments the TEU further comprises a second fan, positioned between the TECs or heat sinks and configured to cool the heat sinks. According to some embodiments, the TEU is further configured to heat water flowing therethrough during a heating mode operation of the climate system. According to some embodiments, the TEU may be switched from a cooling mode to the heating mode by changing current flow therethrough.

According to some embodiments, the system may further include a radiator.

According to some embodiments, the hydraulic system comprises a valve, wherein during a cooling mode of the system, the valve is configured to control water flow from the water tank, via the TEU to the sprinkler tube, and wherein during a heating mode of the system, the valve is configured to draw water from the radiator, via the TEU and back to the radiator. According to some embodiments, the valve is a solenoid valve.

According to some embodiments, the TEU is a thermoelectric generator (TEG). According to some embodiments, the power generated by the TEG is powering at least a portion of the energy required by the system.

According to some embodiments, the microcontroller is controllable via a mobile/tablet application.

According to some embodiments, the power supply is a DC power supply.

According to some embodiments, the system further includes one or more sensors configured to provide feedback to the microcontroller.

According to some embodiments, the one or more sensors is or includes a temperature sensor. According to some embodiments, the microcontroller is configured to maintain a set/selected temperature based on the feedback from the temperature sensor.

According to some embodiments, the one or more sensors is or includes a water level indicator configured to determine a water level in the water tank.

According to some embodiments, the one or more sensors comprises a humidity sensor and wherein the microcontroller is configured to maintain a set/selected humidity, based on the feedback from the humidity sensor.

According to some embodiments, the cooling pads are positioned such that excess water from the wetted cooling pads drips back into the water tank.

According to some embodiments, the cooling pads are honeycomb cooling pads.

According to some embodiments, the one or more fans include one or more cooling mode fans positioned in proximity to the one or more cooling pads and one or more heating mode fans positioned in proximity to the radiator.

According to some embodiments, the one or more cooling mode fans and the one or more heating mode fans each comprise an air intake.

According to some embodiments, the system is devoid of an external unit.

According to some embodiments, the system is portable.

According to some embodiments, the sprinkler tube is closed-ended.

According to some embodiments, there is provided a closed-loop climate system including: an evaporative air conditioning component comprising: a radiator a hydraulic system; and one ore more fans configured to draw-in room air end expel/distribute heated air; a thermoelectric unit (TEU) connectable to a power supply, and configured to heat water flowing therethrough, wherein the TEU is positioned between, and fluidly connected to the radiator, such that water drawn from the radiator is heated by the TEU prior to being returned to the radiator; and a temperature microcontroller configured to control operation of the TEU, thereby controlling the temperature of the expelled/distributed air.

Certain embodiments of the present disclosure may include some, all, or none of the above advantages. One or more technical advantages may be readily apparent to those skilled in the art from the figures, descriptions and claims included herein. Moreover, while specific advantages have been enumerated above, various embodiments may include all, some or none of the enumerated advantages.

In addition to the exemplary aspects and embodiments described above, further aspects and embodiments will become apparent by reference to the figures and by study of the following detailed descriptions.

BRIEF DESCRIPTION OF THE FIGURES

Some embodiments of the disclosure are described herein with reference to the accompanying figures. The description, together with the figures, makes apparent to a person having ordinary skill in the art how some embodiments may be practiced. The figures are for the purpose of illustrative description and no attempt is made to show structural details of an embodiment in more detail than is necessary for a fundamental understanding of the disclosure. For the sake of clarity, some objects depicted in the figures are not drawn to scale. Moreover, two different objects in the same figure may be drawn to different scales. In particular, the scale of some objects may be greatly exaggerated as compared to other objects in the same figure.

In block diagrams and flowcharts, certain steps may be conducted in the indicated order only, while others may be conducted before a previous step, after a subsequent step or simultaneously with another step. Such changes to the orders of the step will be evident for the skilled artisan.

DETAILED DESCRIPTION

Figure 1:
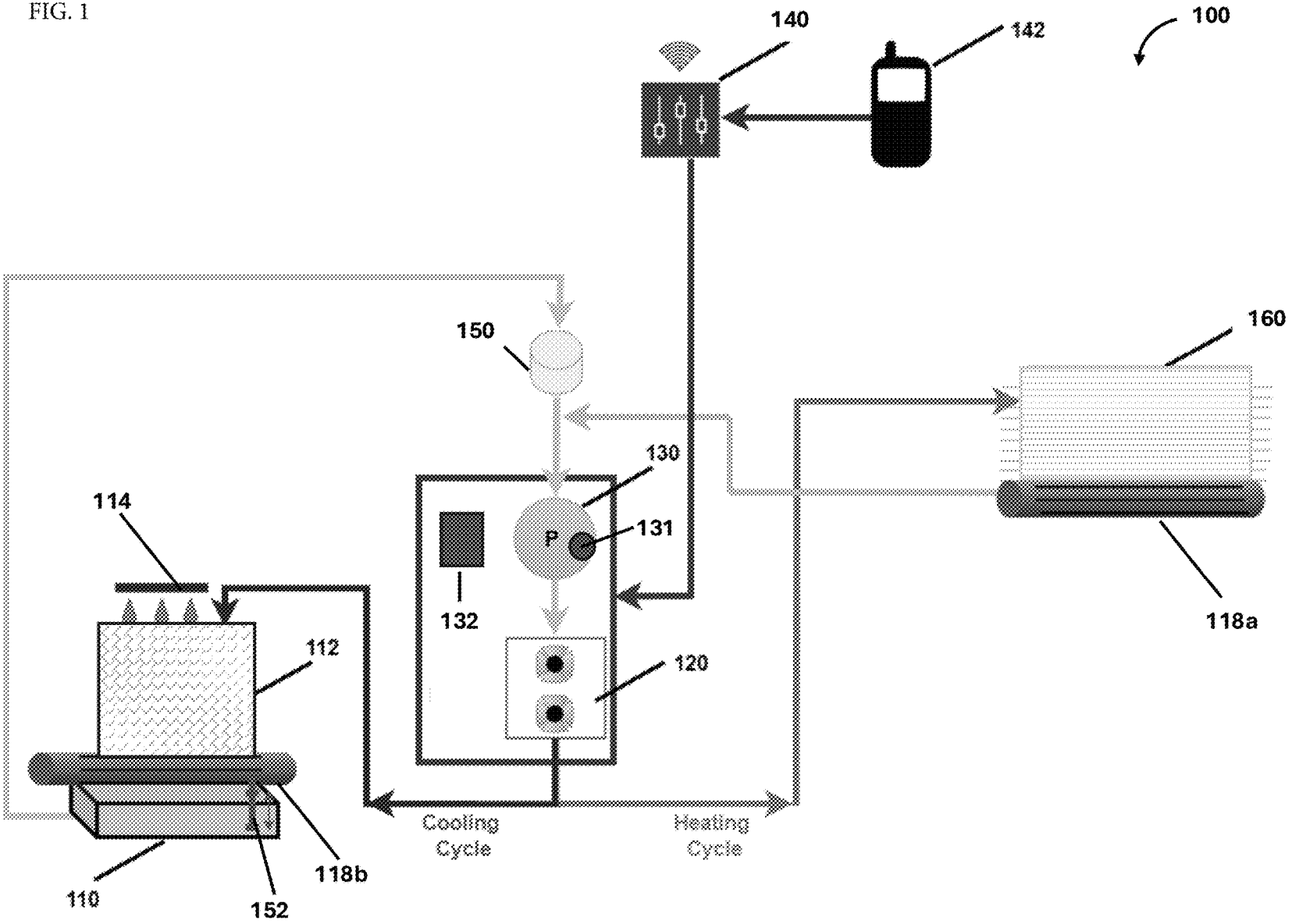
FIG. 1 is a schematic illustration of the herein disclosed thermoelectric evaporative cooling system, according to some embodiments.

In the following description, various aspects of the disclosure will be described. For the purpose of explanation, specific configurations and details are set forth in order to provide a thorough understanding of the different aspects of the disclosure. However, it will also be apparent to one skilled in the art that the disclosure may be practiced without specific details being presented herein. Furthermore, well-known features may be omitted or simplified in order not to obscure the disclosure.

According to some embodiments, there is provided a closed-loop climate system comprising an evaporative air conditioning component.

According to some embodiments, the evaporative air conditioning component includes a water tank; one or more cooling pads positioned above the water tank; and a sprinkler tube (or other water dispersing element such as a sprayer or the like) positioned above the cooling pads and configured to sprinkle water received from the water tank onto the one or more cooling pads (or otherwise wet/humidify the cooling pads).

According to some embodiments, the water tank includes a lid. According to some embodiments, the water tank is rectangular. According to some embodiments, the water tank is L-shaped. According to some embodiments, the water tank is essentially U-shaped. According to some embodiments, the water tank may be connectable to a water supply, such as but not limited to a mains water supply (e.g. of a sink). According to some embodiments, the water tank is not connected to a water supply and may instead be filled manually via an external/separate water supply tank. According to some embodiments, the water tank includes a water level indicator configured to trigger an indication to add water to the tank once a predetermined minimum water level is reached.

According to some embodiments, the term "one or more" with respect to the cooling pads may refer to 1, 2, 3, 4, 5, 6, 7, 8, 9, 10 or more cooling pads. Each possibility is a separate embodiment. According to some embodiments, each side of the water tank may have one or more cooling pads positioned there above. For example, if the water tank is U shaped, each side may have a cooling pad(s) positioned above it. Alternatively, the system may include a single water tank, above which one or more honeycomb pads are positioned.

According to some embodiments, the cooling pads may be made of any material having a high water retention capability. As used herein, the term "high retention capability" refers to materials that can hold at least 3 times, at least 5 times, at least 6-times, at least 10-times, at least 12 times, at least 15-times or at least 20 times their own weight in water. Each possibility is a separate embodiment. According to some embodiments, the material may be capable of holding about 5-15 times its weight in water or about 6-12 times its weight in water. According to some embodiments, the water retention capability is due to the type of material, the porosity of the material, the surface area of the material, the thickness of the material, treatment of the material (e.g. with hydrophilic agents) or any combination thereof. According to some embodiments, the cooling pads may be made of cellulose paper, aspen wood wool, synthetic fibers, natural fibers (e.g. coir) or the like. Each possibility is a separate embodiment. According to some embodiments, the cooling pads may be honeycomb-shaped cooling pads, preferably cellulose paper honey comb cooling pads, more preferably honeycomb-shaped cooling pads treated with a hydrophilic agent, The honeycomb pattern provides a large surface area and allows for structural integrity and durability, so the pads maintain their shape and function even after extended exposure to water and airflow.

According to some embodiments, the sprinkler tube is a closed end sprinkler tube that is positioned along and/or above the cooling pads. That is, if the water tank is U-shaped, the sprinkler tube is positioned above and along the cooling pads of all three sides. Alternatively in case of a flat system, the system includes sprinkler tube positioned above the one or more cooling pad(s) positioned above the water tank. According to some embodiments, the sprinkler tube has a plurality (e.g. at least 20, at least 50, at least 100 or more) of sprinkler holes through which water from the water tank can be sprinkled on the cooling pads. Each possibility is a separate embodiment. That is, in operation, the sprinkler tube receives water from the water tank via its open end while water exits that sprinkler tube onto the cooling pads via the sprinkler holes.

According to some embodiments, the evaporative air conditioning component further includes a pump or other hydraulic system configured to draw water from the water tank to the sprinkler tube.

According to some embodiments, the evaporative air conditioning component further includes one or more fans (e.g. 1, 2, 3, 5 or more fans) configured to draw-in room air end expel/distribute air cooled via the cooling pads. Each possibility is a separate embodiment. According to some embodiments, the fan is positioned behind or in front of a front-facing cooling pad of the one or more cooling pads. According to some embodiments, the one or more fans are axial fan, cross flow fans, vertical fans or any combination thereof. Each possibility is a separate embodiment. According to some embodiments, at least a portion of the one or more fans include an air intake configured to maximize the concentration of air passing through cooling pad/radiator via the one or more fans.

According to some embodiments, the evaporative air conditioning component further includes a thermoelectric unit (TEU) that converts temperature differences directly into electricity or, conversely, uses electricity to create a temperature difference. According to some embodiments, the TEU is connectable to a power supply, and configured to cool/heat water flowing therethrough. According to some embodiments, the TEU is positioned between, and fluidly connected to the water tank and the sprinkler tube, such that water drawn from the water tank is cooled by the TEU prior to reaching the sprinkler tube. According to some embodiments, the power supply is a DC power supply. As used herein, the term "one or more" with respect to the TEU refers to 1, 2, 3, 4, or 5 TEUs. Each possibility is a separate embodiment.

According to some embodiments, the evaporative air conditioning component further includes a temperature microcontroller configured to control operation of the TEU, thereby controlling the temperature of the expelled/distributed air. According to some embodiments, the microcontroller is controllable via a mobile/tablet application.

According to some embodiments, the evaporative air conditioning component may further include one or more sensors configured to provide feedback to the microcontroller. According to some embodiments, the one or more sensors may include a temperature sensor. According to some embodiments, wherein the microcontroller is configured to maintain a set/selected temperature based on the feedback from the temperature sensor. According to some embodiments, the one or more sensors may include a humidity sensor. According to some embodiments, the microcontroller is configured to maintain a set/selected humidity, based on the feedback from the humidity sensor.

According to some embodiments, the TEU includes one or more heat exchangers having a water inlet and a water outlet; one or more thermoelectric modules (TEM); and one or more heat sinks. As used herein, the term "one or more" with respect to TEU components refers to 1, 2, 3, 4, or 5 components. Each possibility is a separate embodiment.

According to some embodiments, the TEU further includes an auxiliary fan, configured to cool the heat sinks. According to some embodiments, the TEU fan may be positioned between the TEMs or heat sinks.

According to some embodiments, by changing current flow therethrough, the TEU is further configured to heat water flowing therethrough. Accordingly, the system may advantageously further function as a radiator.

According to some embodiments, the hydraulic system may include one or more valves (e.g. 1, 2, 3, or more valves. Each possibility is a separate embodiment. According to some embodiments, the one or more valves is a solenoid valve. According to some embodiments, during a cooling mode of the system, at least one of the valves is configured to control water flow from the water tank, via the TEU to the sprinkler tube during cooling mode, and during a heating mode in a closed loop from the radiator to the TEU (for heating) and back to the radiator.

According to some embodiments, the TEU is a thermoelectric generator (TEG). According to some embodiments, the power generated by the TEG is powering at least a portion of the energy required by the system.

According to some embodiments, the excess water from the wetted cooling pads drips back into the water tank.

According to some embodiments, the system is devoid of an external unit.

According to some embodiments, the system is portable.

Reference is now made to FIG. 1, which schematically illustrate the structural setup and operation of herein disclosed thermoelectric evaporative cooling system 100, according to some embodiments.

Thermoelectric evaporative cooling system 100 includes:

a) an evaporative air conditioning component including:

i. a water tank 110. Water tank 110 may be rectangular (flat), U-shaped or any other shape;

ii. one or more cooling pads 112, preferably positioned above the water tank, such that residual water drips down from the cooling pads back into the water tank, the cooling pads are preferably honeycomb cooling pads made of cellulose paper;

iii. a closed-end sprinkler tube 114, positioned above cooling pad 112. Sprinkler tube 114 includes sprinkler holes configured to allow passage of water therethrough for sprinkling on cooling pad 112;

iv. a first fan 118*a* configured to generate circulation, such that room air is entered into thermoelectric evaporative cooling system 100 and exits into the room via cooling pad 112, whereby the air is cooled. According to some embodiments, fan 118*a* may be an axial fan, a cross flow fan or a vertical fan.

v. An air intake/air collector (not shown) located next to cooling pad 112 and configured to maximize the concentration of air passing through cooling pad 112.

b) A thermoelectric unit (TEU) 120. TEU 120 preferably includes one or more thermoelectric modules, each module comprising a heat exchanger, a heat sink and a fan (items not shown). The fan is configured to remove the excess energy from the heat sinks. Advantageously, the TEU may also serve as a thermoelectric generator (TEG), which in turn can be used for supplying power to other system components, thereby further reducing energy and wiring requirements.

c) A hydraulic system 130 configured to pump water from the water tank to the thermoelectric module. During cooling operation, the water is pumped into the TEU where it is cooled and transferred into the sprinkler tube 114. Hydraulic system 130 is operationally connected to a power source 132.

d) According to some embodiments, thermoelectric evaporative cooling system 100 may further include a controller such as microcontroller 140 configured to control operation of the TEU, thereby controlling the temperature of the expelled/distributed air. According to some embodiments, microcontroller 140 may be operated via an external device, such as but not limited to a mobile phone 142, preferably via a dedicated App.

e) According to some embodiments, thermoelectric evaporative cooling system 100 may further include a filter 150 configured to filter the water received from the cooling tank prior to it reaching the heat exchanger.

f) According to some embodiments, the thermoelectric evaporative cooling system 100 may include one or more sensors that by providing signals to microcontroller 140 automatically ensure that a desired temperature is maintained.

g) According to some embodiments, water tank 110 may include a water level sensor 152 operationally connected to microcontroller 140 and configured to trigger an indication when water needs to be added to the water tank.

According to some embodiments, thermoelectric evaporative cooling system 100 may also operate as a heater in which case the system also includes a radiator 160. That is, in this case water is heated in the TEU and then supplied to a radiator, an air intake/air collector (not shown), located next to the radiator, maximizes the concentration of the air passing there through prior to being expelled into the room. It is understood that in the heating mode the heated water is supplied directly to radiator (without passing cooling pad 112). According to some embodiments, the heating mode operates in a closed-loop. That is, water in the radiator (delivered during initial installation), is drawn by hydraulic system 130 to TEC 120 where it is heated and the delivered back to radiator 160. Air distributed via a second fan(s) 118*b* is passed through radiator 160, where it is heated and further into the surroundings. According to some embodiments, fan 118*b* may be an axial fan, a cross-flow fan or a vertical fan.

In a dual operation (heating and cooling), hydraulic system 130 may include a valve 131, such as but not limited to a solenoid valve. According to some embodiments, the (solenoid) valve directs water flow from the water tank, via the TEU to the sprinkler tube in a cooling mode operation, and from the TEU to the radiator in a heating mode operation. According to some embodiments, the system includes additional (solenoid) valves (not shown) for other system needs.

Figure 2A:
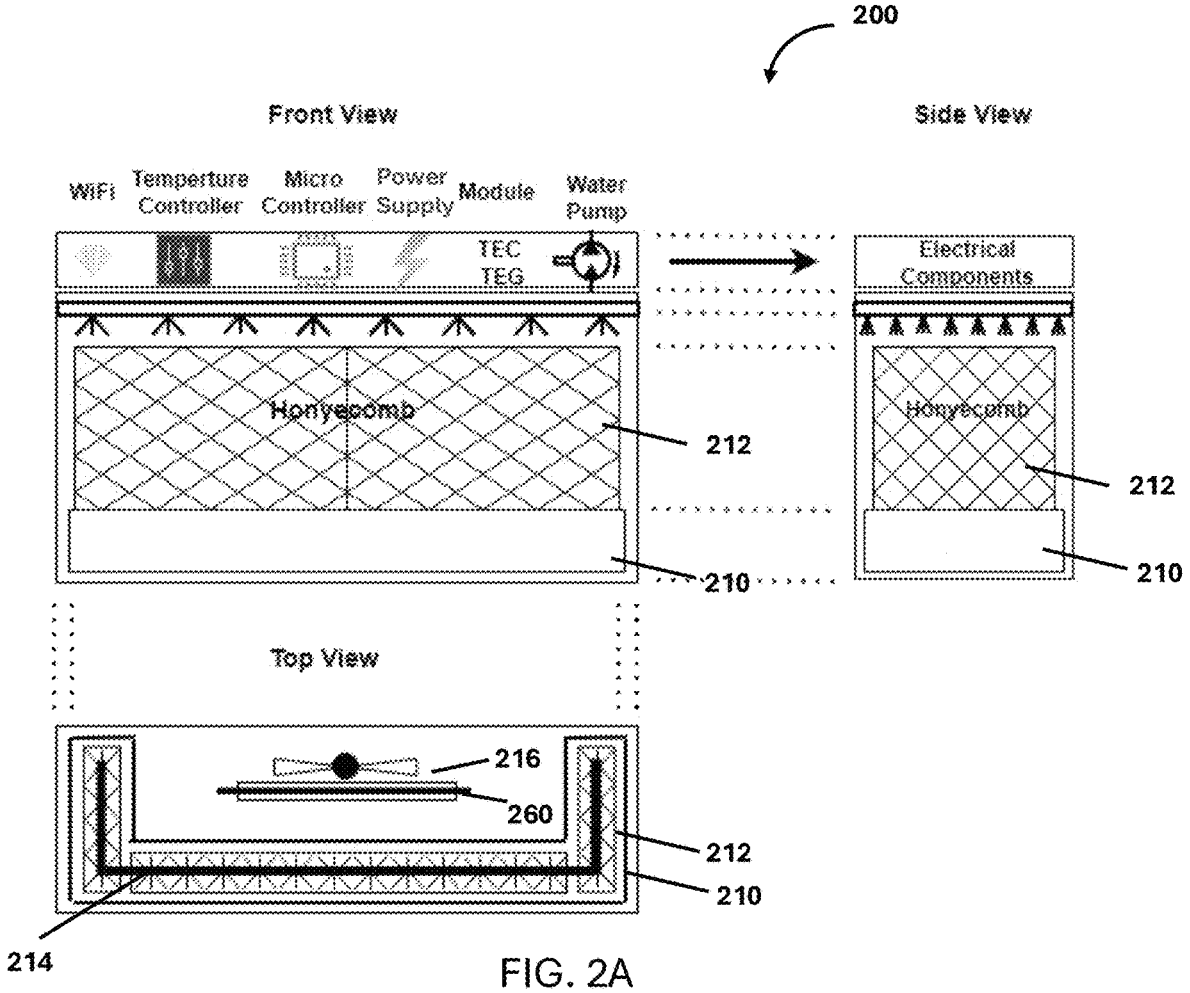
FIG. 2A show front view, side view and top view of the herein disclosed U-shaped evaporative air conditioning component.
Figure 2B:
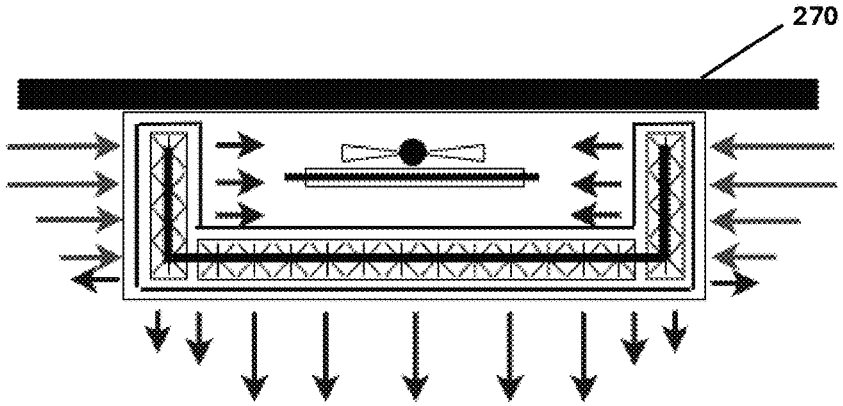
FIG. 2B shows a top view of the air flow of the herein disclosed U-shaped evaporative air conditioning component

Reference is now made to FIG. 2A and FIG. 2B, which shows front, top and side views of a U-shaped evaporative air conditioning component 200, respectively, and to and FIG. 2B which shows the airflow through the evaporative air conditioning component 200; according to some embodiments.

As seen from FIG. 2A, facing the front of evaporative air conditioning component 200 are honeycomb pads 212 and the U-shaped wall of water tank 210 as well as a functional display displaying one or more (or all) of: evaporative air conditioning component 200 such as Wifi connection, a temperature set by the microcontroller. Microcontroller, power supply, TEU operation, and operation of water pump. As seen from the top view, evaporative air conditioning component 200 include sprinkler tube(s) poisoned above and along honeycomb pads 212, and a fan 216. Fan 216 is positioned behind honeycomb pads 212. However, another configuration at which fan 216 is positioned in front of honeycomb pads 212 is also envisaged. Fan 216 is configured to generate an airflow as illustrated in FIG. 2B. That is, warm ambient air enters into thermoelectric evaporative cooling system 200 (as illustrated by red and inwards pointing arrows) and cooled air exits into the room via the cooling pads 212 (as illustrated by blue outwards pointing arrows). As further seen in FIG. 2B, thermoelectric evaporative system 200 may optionally be installed (attached to) a wall 270). According to some embodiments, system 200 may optionally also have a heating mode, in which case a radiator 260 is included.

Figure 3A:
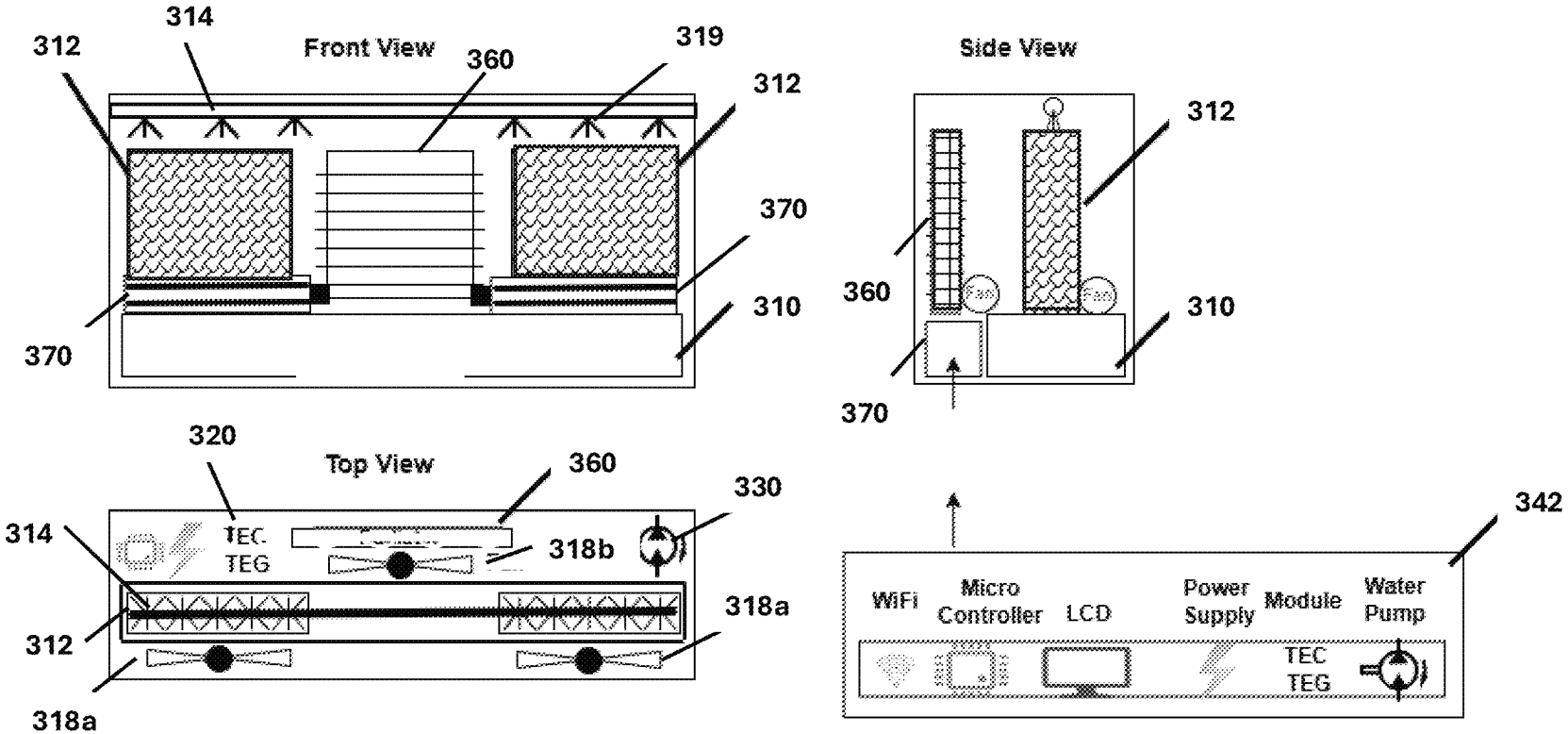
FIG. 3A shows the system air flow of the herein disclosed flat evaporative air conditioning component.

Reference is now made to FIG. 3A, which shows front, top and side views of a flat evaporative air conditioning component 300, respectively, and to and FIG. 2B which shows the airflow through the evaporative air conditioning component 300; according to some embodiments.

As seen from FIG. 3A, facing the front of evaporative air conditioning component 300 are honeycomb pads 312 and a water tank 310 As seen from the top view, evaporative air conditioning component 300 includes a sprinkler tube 314 extending above and along honeycomb pads 312 and fans 318*a* are positioned in front of honeycomb pads 112. However, another configuration at which fans 318*a*. Fans 318*a* are positioned in front of honeycomb pads 312 however a configuration where fans 318*a* are poisoned behind honeycomb pads 312 is also envisaged. Fans 318*a* include air intakes configured to generate an optimal airflow within air conditioning component 300, That is, warm ambient air enters into evaporative air conditioning component 300 from its bottom and top whereas cooled air exits via outlets on the front face of evaporative air conditioning component 300.

Evaporative air conditioning component 300 also includes a radiator 360 for a heating mode operation. Water is drawn from radiator 360 by hydraulic system 330 via TEC module, where it is heated and returned to radiator 360. Ambient air is circulated from the room (not shown) to the radiator for heating and subsequently expelled back into the room. According to some embodiments, honeycomb pads 312 and fans 318*a* are poisoned closer to a front face of evaporative air conditioning component 300, than radiator 360 and fan 318*b*. According to some embodiments, evaporative air conditioning component 300 includes two sets of cooling elements (honeycomb pads 312 and fans 318*a*) each positioned on opposite lateral sides of evaporative air conditioning component 300, whereas radiator 360 and fan 318*b* is positioned between the two sets of cooling elements.

Advantageously, fans 318*a* and 318*b* include air intakes configured to maximize the passage of air via the cooling pads/radiator respectively.

Evaporative air conditioning component 300 also includes electrical/hydraulic components 370 (e.g. temperature sensor, water level sensor, valves etc.) and a functional display 342 displaying one or more (or all) operational status of components 370 such as Wifi connection, temperature set by the microcontroller, power supply, TEU operation, operation of hydraulic system 330, etc.

Figure 3B:
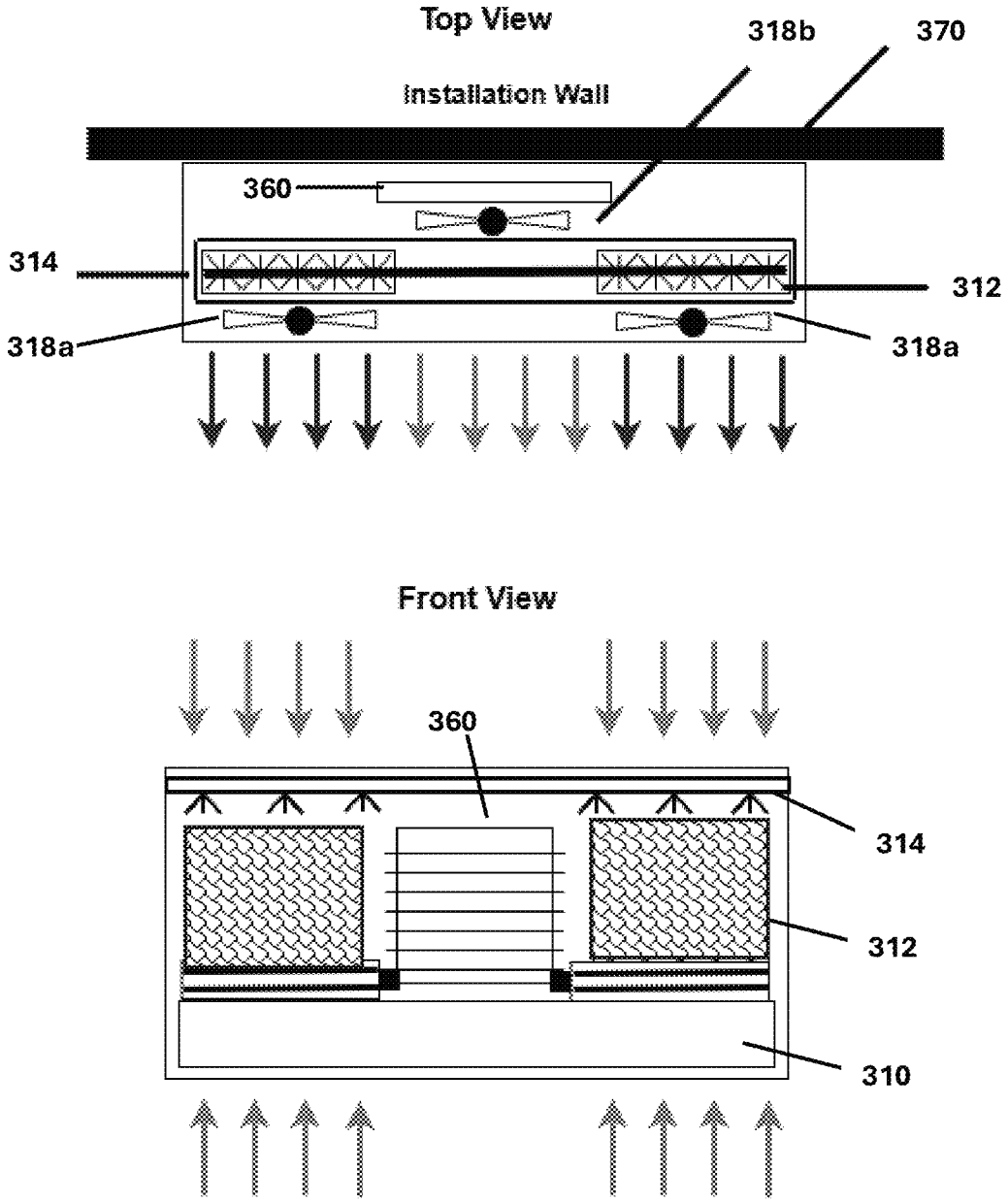
FIG. 3B shows a top view and a side view of the air flow of the herein disclosed flat evaporative air conditioning component.

FIG. 3B shows a top view and a side view of the air flow in thermoelectric evaporative air conditioning component 300 (here illustrated as installed (attached to) a wall 370). As seen from the front view, ambient air enters evaporative air conditioning component 300 via (not shown) on its top and bottom. The air is then directed through honeycomb pads 312 during cooling mode or through radiator 360 during heating mode whereafter the cooled/heated air is expelled via respective outlets (not shown) on a front face of evaporative air conditioning component 300.

Figure 4:
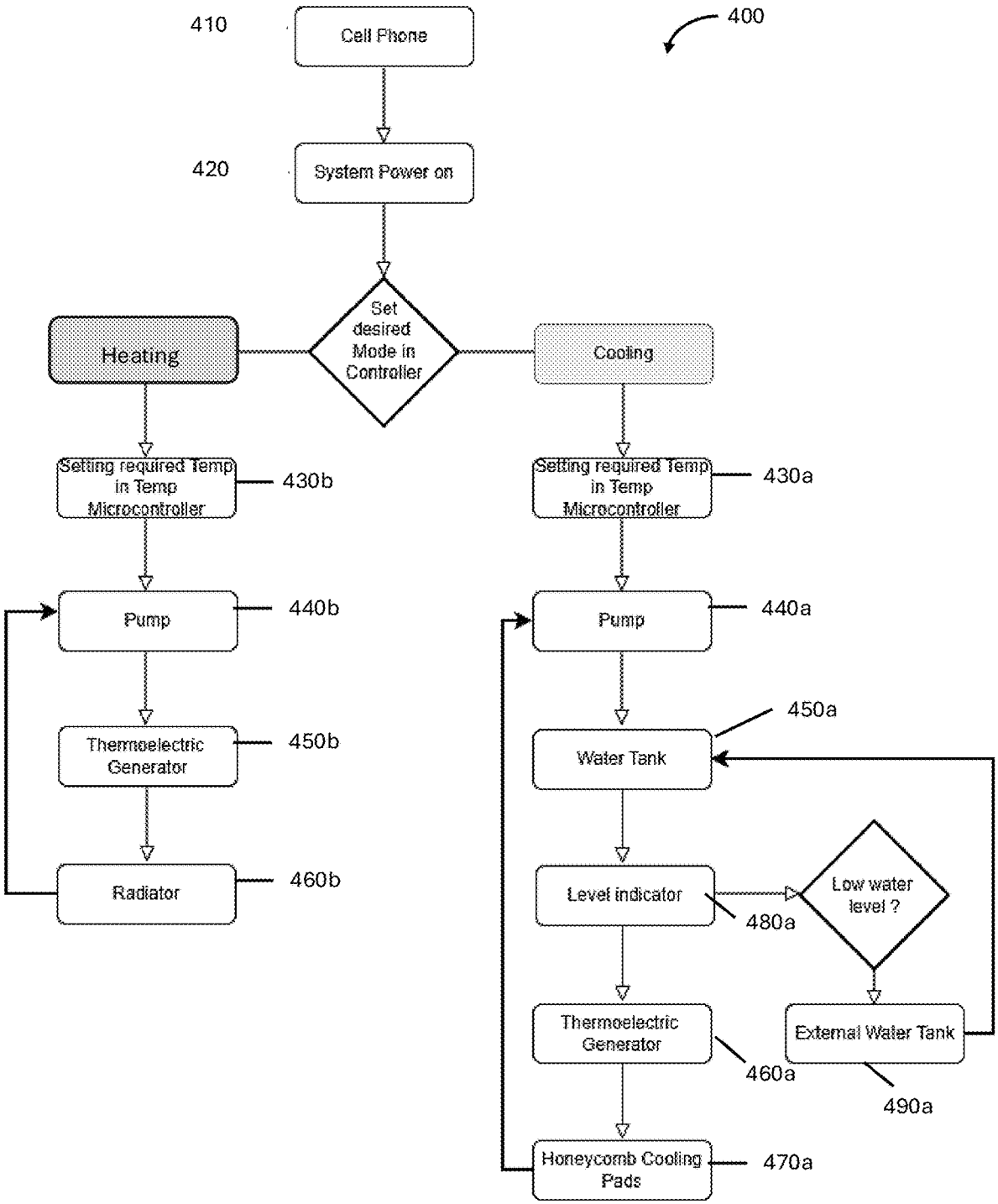
FIG. 4 is a functionality block diagram of the herein disclosed thermoelectric evaporative cooling system, according to some embodiments.

FIG. 4 is a functionality block diagram 400 of the herein disclosed thermoelectric evaporative system during heating and cooling respectively.

In step 410 and 420 (which are common to both cycles) a user wishing to operate the thermoelectric evaporative cooling system, such as thermoelectric evaporative cooling system 100, 200 or 300 may enter a dedicated App on his/her mobile device to turn the system on and to select which mode of operation (cooling or heating) is desired.

If a cooling mode of operation is selected the following steps take place:

In step 430*a* a required/desired temperature is set via the microcontroller. In step 440*a* and 450*a* the hydraulic system is activated so as to draw water from the water tank via the Thermoelectric Unit (TEU) (step 460*a*) where it is cooled and then subsequently sprinkled onto the cooling pads (step 470*a*), via sprinkler tubes, as further elaborated herein. Excess water dripping down from the cooling pads will be recycled back to the water tank, thereby generating a closed loop operation system. It is noted that during use the water level in the water tank is reduced (due to evaporation thereof), accordingly, in the cooling mode operation of method 400, a water level is determined using a water level sensor (step 480*a*). Based on the water level, water may be supplied to the water tank (step 490*a*) optionally automatically from an external water tank (as here indicated), automatically via a water pipe, or manually by a user.

If a heating mode of operation is selected the following steps take place:

In step 430*b* a required/desired temperature is set via the temperature microcontroller. In step 440*b* the hydraulic system is activated so as to draw water from the radiator to the Thermoelectric Unit (TEU) (step 450*b*) where it is heated and then subsequently returned to radiator (step 460*b*), configured to heat air flowing therethrough. Excess water may be recycled back from the radiator to the water tank, thereby generating a closed loop operation system.

According to some embodiments, prior to a first use of herein disclosed thermoelectric evaporative system, the method includes a step of filling up the radiator with water from the water tank (by operation of the same or a different hydraulic system). It is understood that since the heating mode may be entirely closed looped, no subsequent withdrawal of water from the water tank is carried out during heating mode.

Although some embodiments of the invention are not limited in this regard, discussions utilizing terms such as, for example, "processing," "computing." "calculating," "determining," "establishing". "analyzing", "checking", "detecting", "identifying", "characterizing", or the like, may refer to operation(s) and/or process(es) of a computer, a computing platform, a computing system, or other electronic computing device, that manipulates and/or transforms data represented as physical (e.g., electronic) quantities within the computer's registers and/or memories into other data similarly represented as physical quantities within the computer's registers and/or memories or other information non-transitory storage medium that may store instructions to perform operations and/or processes. Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. The term set when used herein may include one or more items. Unless explicitly stated, the method embodiments described herein are not constrained to a particular order or sequence. Additionally, some of the described method embodiments or elements thereof can occur or be performed simultaneously, at the same point in time, or concurrently.

As used herein, the terms "approximately", "essentially" and "about" in reference to a number are generally taken to include numbers that fall within a range of 5%, 2.5% or in the range of 1% in either direction (greater than or less than) the number unless otherwise stated or otherwise evident from the context (except where such number would exceed 100% of a possible value). Where ranges are stated, the endpoints are included within the range unless otherwise stated or otherwise evident from the context.

As used herein, the singular forms "a," "an" and "the" include plural referents unless the context clearly dictates otherwise.

As used herein, "optional" or "optionally" means that the subsequently described event or circumstance does or does not occur, and that the description includes instances where said event or circumstance occurs and instances where it does not.

It is appreciated that certain features of the disclosure, which are, for clarity, described in the context of separate embodiments, may also be provided in combination in a single embodiment. Conversely, various features of the disclosure, which are, for brevity, described in the context of a single embodiment, may also be provided separately or in any suitable sub-combination or as suitable in any other described embodiment of the disclosure. No feature described in the context of an embodiment is to be considered an essential feature of that embodiment, unless explicitly specified as such.

Although stages of methods, according to some embodiments, may be described in a specific sequence, the methods of the disclosure may include some or all of the described stages carried out in a different order. In particular, it is to be understood that the order of stages and sub-stages of any of the described methods may be reordered unless the context clearly dictates otherwise, for example, when a latter stage requires as input an output of a former stage or when a latter stage requires a product of a former stage. A method of the disclosure may include a few of the stages described or all of the stages described. No particular stage in a disclosed method is to be considered an essential stage of that method, unless explicitly specified as such.

Although the disclosure is described in conjunction with specific embodiments thereof, it is evident that numerous alternatives, modifications, and variations that are apparent to those skilled in the art may exist. Accordingly, the disclosure embraces all such alternatives, modifications, and variations that fall within the scope of the appended claims. It is to be understood that the disclosure is not necessarily limited in its application to the details of construction and the arrangement of the components and/or methods set forth herein. Other embodiments may be practiced, and an embodiment may be carried out in various ways.

While certain embodiments of the invention have been illustrated and described, it will be clear that the invention is not limited to the embodiments described herein. Numerous modifications, changes, variations, substitutions and equivalents will be apparent to those skilled in the art without departing from the spirit and scope of the present invention as described by the claims, which follow.

The invention claimed is:

1. A closed-loop climate system comprising:

an evaporative air conditioning component comprising:

a water tank;

one or more cooling pads positioned above the water tank, each of the cooling pads being configured to absorb liquid and to allow air to pass transversely therethrough;

a sprinkler tube positioned along and above the one or more cooling pads, the sprinkler tube comprising a plurality of sprinkler holes through which water from the water tank can be sprinkled on the one or more cooling pads;

a hydraulic system configured to draw water from the water tank to the sprinkler tube; and one or more fans configured to draw-in room air and to expel/distribute air cooled via the cooling pads;

a thermoelectric unit (TEU) connectable to a power supply, and configured to cool water flowing therethrough and to heat water flowing therethrough during a heating mode operation of the climate system, wherein the TEU is positioned between, and fluidly connected to the water tank and the sprinkler tube, such that water draw from the water tank is cooled by the TEU prior to reaching the sprinkler tube, wherein, the climate system is configured to be switched from a cooling mode to the heating mode by changing current flow through the TEU; and a temperature microcontroller configured to control operation of the TEU, thereby controlling the temperature of the expelled/distributed air;

a radiator; and a valve, wherein during a cooling mode of the system, the valve is configured to control water flow from the water tank, via the TEU to the sprinkler tube, and wherein during a heating mode of the system, the valve is configured to draw water from the radiator, via the TEU and back to the radiator.

2. The system of claim 1, wherein the TEU is a thermoelectric generator (TEG) and wherein the power generated by the TEG is powering at least a portion of the energy required by the system.

3. The system of claim 1, wherein the temperature microcontroller is controllable via an application running on a remote computing device.

4. The system of claim 1, wherein the power supply is a DC power supply.

5. The system of claim 1, further comprising one or more sensors configured to provide feedback to the temperature microcontroller.

6. The system of claim 5, wherein the one or more sensors comprises a temperature sensor and wherein the temperature microcontroller is configured to maintain a set/selected temperature based on the feedback from the temperature sensor.

7. The system of claim 5, wherein the one or more sensors comprises a water level indicator configured to determine a water level in the water tank.

8. The system of claim 5, wherein the one or more sensors comprises a humidity sensor and wherein the temperature microcontroller is configured to maintain a set/selected humidity, based on the feedback from the humidity sensor.

9. The system of claim 1, wherein the cooling pads and the water tank are mutually positioned such that excess water drips back into the water tank.

10. The system of claim 1, wherein the cooling pads are honeycomb cooling pads.

11. The system of claim 1, being configured to selectively operate in one of a cooling mode and a heating mode wherein the one or more fans comprise a one or more cooling mode fans positioned in proximity to the one or more cooling pads and one or more heating mode fans positioned in proximity to a radiator.

12. The system of claim 11, wherein the one or more cooling mode fans and the one or more heating mode fans each comprise an air intake.

13. The system of claim 1, being devoid of an external unit.

* * * * *